United States Patent [19]

Meek

[11] Patent Number: 4,862,976

[45] Date of Patent: Sep. 5, 1989

[54] SPLINE DRIVE FOR PERCUSSION DRILLING TOOL

[75] Inventor: James F. Meek, Houston, Tex.

[73] Assignee: Sandvik Rock Tools, Inc., Bristol, Va.

[21] Appl. No.: 274,964

[22] Filed: Nov. 22, 1988

[51] Int. Cl.[4] ..... E21B 10/38; E21B 17/046

[52] U.S. Cl. ..... 175/296; 175/321; 175/415; 175/417; 464/162

[58] Field of Search ..... 175/92, 107, 296, 306, 175/320, 321, 414, 415, 417–419, 395; 173/104; 464/162, 169

[56] References Cited

U.S. PATENT DOCUMENTS

| | | | |
|---|---|---|---|
| 41,651 | 2/1864 | Taylor . | |
| 2,479,698 | 8/1949 | Paquin | 175/417 X |
| 2,813,450 | 11/1957 | Dzus . | |
| 3,225,843 | 12/1965 | Ortloff et al. | 175/321 X |
| 3,269,470 | 8/1966 | Kelly, Jr. | 175/415 X |
| 3,334,693 | 8/1967 | Badcock | 173/109 |
| 3,382,936 | 5/1968 | Galle | 175/321 |
| 3,399,549 | 9/1968 | Nagele | 464/162 X |
| 3,470,786 | 10/1969 | Martins . | |
| 3,733,853 | 5/1973 | Sutliff et al. . | |
| 3,805,552 | 4/1974 | Heald | 464/162 X |
| 3,885,480 | 5/1975 | Muenchinger | 81/121.1 |
| 3,918,538 | 11/1975 | Bender | 175/417 X |
| 4,257,161 | 3/1981 | Bijl et al. | 30/43.6 |
| 4,281,726 | 8/1981 | Garrett | 175/321 |

*Primary Examiner*—Stephen J. Novosad

*Attorney, Agent, or Firm*—Burns, Doane, Swecker & Mathis

[57] ABSTRACT

In a percussion drilling tool, a bit is connected to a drill motor through a mating spline connection. External splines on the bit engage internal splines in the drill motor and have respective load bearing faces disposed in a plane extending radially outwardly from central axes. The splines also include a crest land, and a root land. When the splines are in an abutting centered position, there is a uniform radially measured outer clearance between the external spline crests and the internal spline roots, and a uniform radially measured inner clearance between the external spline roots and the internal spline crests. The outer clearance is less than the inner clearance to prevent abrasive damage below the root diameter of the bit resulting from axial relative movement so that the external spline crests will engage the associated internal spline roots while continually maintaining a spacing between the external spline roots and the internal spline crests.

14 Claims, 2 Drawing Sheets

SPLINE DRIVE FOR PERCUSSION DRILLING TOOL

TECHNICAL FIELD

The subject invention relates to a spline drive connection between a bit and a drill motor of an earth penetrating percussion drilling tool. Specifically, the invention relates to such a spline connection wherein the load bearing faces of the mating internal and external splines extend radially outwardly from a central axis and a functional clearance relationship is provided between crests and roots of the mating internal and external splines.

BACKGROUND OF THE INVENTION

When drilling into hard earth, such as rock, it is necessary to produce an impact force at a penetrating end of a drilling tool in order to pierce through the rock. Typically, the drilling tool includes a drill motor energized by pressurized fluid, such as compressed air, to reciprocate a piston against a bit and thus create the necessary impact force to drive the drilling tool deeper into the earth. The drill motor and bit are separate elements joined together by a suitable connection allowing the drill motor to be the driver element and the bit to be driven element. In this manner, axial and torsional forces are transmitted from the drill motor to the bit.

The prior art teaches the use of mating spline connections between the drill motor and the bit to transfer torsional force from the drill motor to the bit and provide for axial movement of the bit relative to the drill motor upon impact of the piston. Conventional splines on bits and drill motors are manufactured so that the load bearing and non-load bearing faces of the splines straddle the radial center lines of both the driver and driven elements. When a rotational force is applied to the driver element, the driver element rotates about its axis until its load bearing spline faces contact the load bearing spline faces of adjacent splines on the driven element. The result is a point contact due to misalignment of the load bearing spline faces. This point contact, coupled with the axial relative movement between the bit and drill motor, causes rapid wear, galling and stress concentrations in the splines. Hence, the common prior art spline connection between a bit and a drill motor is susceptible to premature failure due in part to the shape of the load bearing spline faces.

In order to overcome this point contact due to misalignment of spline faces, the prior art teaches to orient the load bearing faces of both driver and driven splines in radial planes so that upon contact the entire surface of each of the load bearing faces makes contact. As perhaps best shown in Badcock U.S. Pat. No. 3,334,693 issued Aug. 8, 1967, a jack hammer tool is disclosed including a splined coupling having three radially extending load bearing faces on the mating internal and external splines. A uniform radially measured clearance is provided between the internal and external splines, whereby a lateral shift of one of the splines relative to a centered position results in an undesirable contact between the internal and external splines at locations other than the load bearing faces. When this contact at locations other than the load bearing faces is coupled with relative axial movement between the two members, abrasion in the form of galling will result. In the Badcock connection, this undesirable contact can occur at any location between the spline members due to the equal clearance spacing. When galling occurs at or near the roots of the external threads, a reduction in the critical root diameter of the external spline supporting member, e.g., bit shank, results thereby substantially reducing the structural integrity of the damaged member.

SUMMARY OF THE INVENTION AND ADVANTAGES

The subject invention provides a percussion drilling apparatus of the type for boring into the earth. The apparatus comprises a drill motor means for producing a cyclic percussive force having a longitudinally extending central axis and a bore centered along the central axis presenting a series of axially extending circumferentially spaced internal splines. A bit means is provided for leading the drill motor means into the earth. The bit means has a centered position in the bore of the drill motor means defined by an axis thereof aligned with the central axis. The bit means presents a series of axially extending circumferentially spaced external splines engaging the internal splines in the centered position. The internal and external splines are disposed for axial relative movement and torsional transmission therebetween and each spline has a load bearing face extending in a plane radially outwardly from the central axis, a crest land extending circumferentially away from the load bearing face, a non-load bearing face extending away from the crest, and a root land extending between the non-load bearing face and the load bearing face of an adjacent spline. The splines in the center position include a uniform radially measured outer clearance between the external spline crests and the internal spline roots and a uniform radially measured inner clearance between the external spline roots and the internal spline crests. The outer clearance is smaller than the inner clearance to prevent abrasive damage to the external spline roots during axial relative movement between the drill motor means and the bit means so that the external spline crests engage the internal spline roots when the axis of the bit means shifts laterally of the central axis and away from the centered position while maintaining a clearance between the external spline roots and the internal spline roots.

The subject invention overcomes deficiencies of the prior art spline connections between a drill motor and a bit of a percussion drilling tool by providing, in combination, radially extending load bearing faces which make surface contact rather than point contact. Also provided is a novel relationship between the outer clearance and the inner clearance wherein, upon lateral misalignment from the centered position, only the external spline crests engage and rub against the internal spline roots while a spacing is continually maintained between the external spline roots and the internal spline crests. In other words, during lateral misalignment, the outer clearance will yield to contact between the associated lands, but the inner clearance will not yield below a predetermined spacing, thus preventing abrasive damage to the roots of the bit.

The desired result is to prevent breakage of the bit during operation. According to the subject invention, the root diameter of the bit will not be appreciably abraded, and thus the structural integrity of the bit will not be jeopardized. Any galling which occurs to the bit due to abrasive action will instead manifest along the crest lands and the load bearing faces of the external splines. Because the external spline roots will never be contacted during operation, the structural integrity of the bit will not diminish.

BRIEF DESCRIPTION OF THE DRAWING

The objects and advantages of the invention will become apparent from the following detailed description of a preferred embodiment thereof in connection with the accompanying drawings, in which like numerals designate like elements, and in which.

DETAILED DESCRIPTION OF A PREFERRED EMBODIMENT OF THE INVENTION

Figure 1:
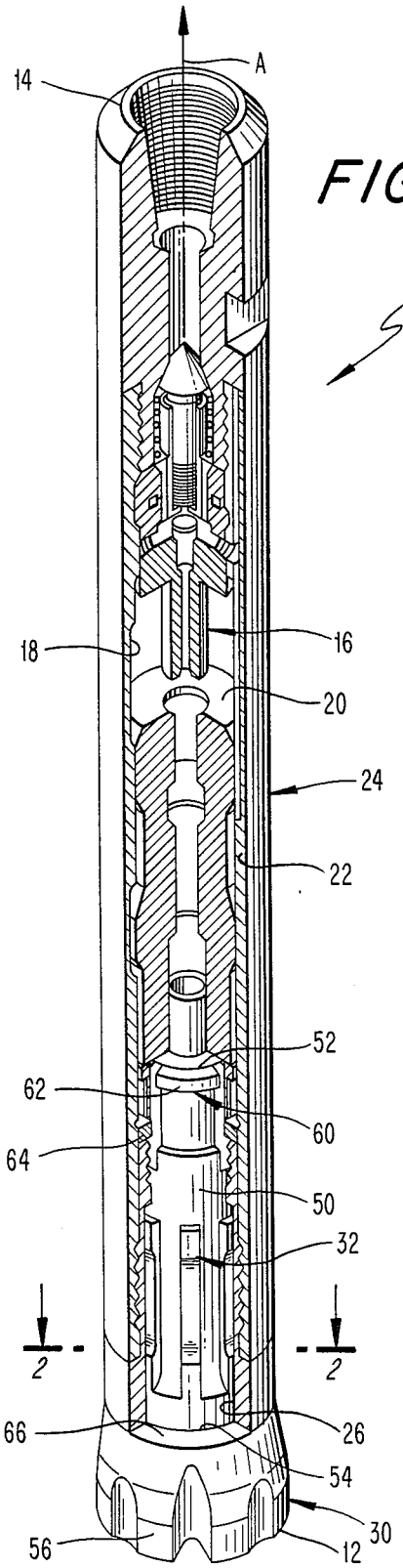
FIG. 1 is a partially sectioned perspective view of a percussion drilling tool according to the present invention.

A percussion drilling tool according to the present invention is generally shown at 10 in FIG. 1. The drilling tool 10 is of the type for boring into the earth, and more particularly, through rock embedded in the earth. The drilling tool 10 is affixed to the end of a long shaft, or series of shaft sections, and directed downwardly into the earth. The drilling tool 10 includes an anterior end 12 and a posterior end 14. Compressed air is supplied to the drilling tool 10 via an opening in the posterior end 14. The compressed air passes through a valve assembly, generally indicated at 16, and into a cylinder 18. A piston 20 is reciprocated in the cylinder 18 by the compressed air. With each downward stroke of the piston 20, a percussive force is created at the anterior end 12 to facilitate boring through the hard rock in the earth.

The elements of the drilling tool 10 which include the posterior end 14, the valve assembly 16, the cylinder 18, and the piston 20, along with an outer jacket or casing 22, comprise a drill motor, which is generally indicated at 24 in FIG. 1, for producing the cyclic percussive force. The drill motor 24 has a longitudinally extending central axis A. A bore 26 is provided in the drill motor 24 adjacent the anterior end 12. The bore 26 is centered along the central axis A and presents a series of axially extending circumferentially spaced internal splines, generally indicated at 28 in FIGS. 2 and 3.

Figure 4:
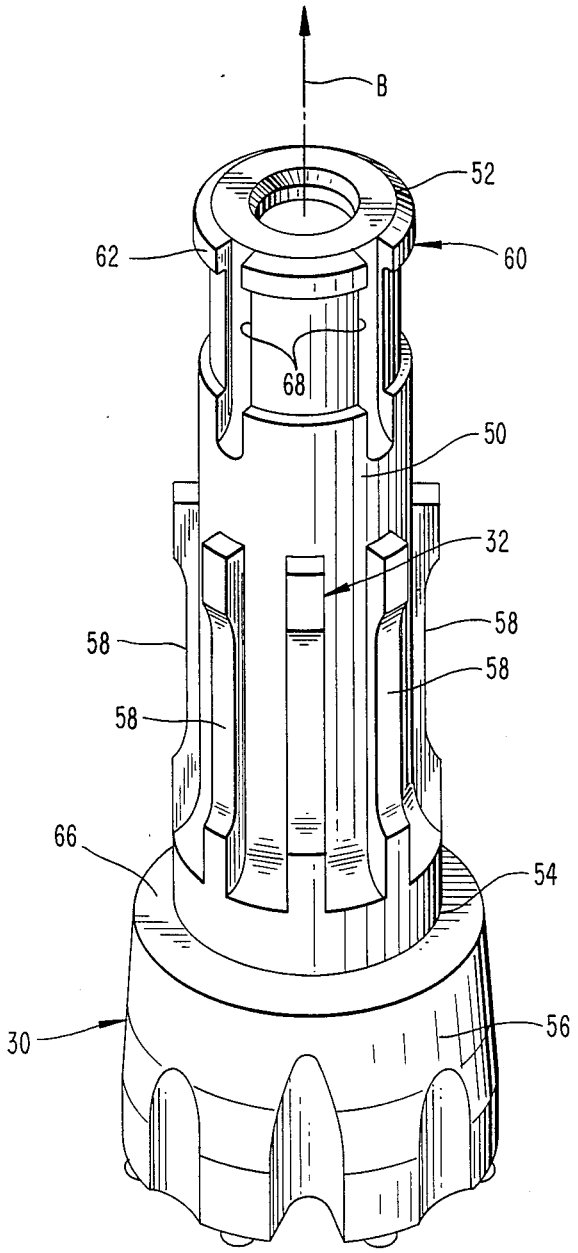
FIG. 4 is a perspective view of a bit according to the subject invention.
Figure 2:
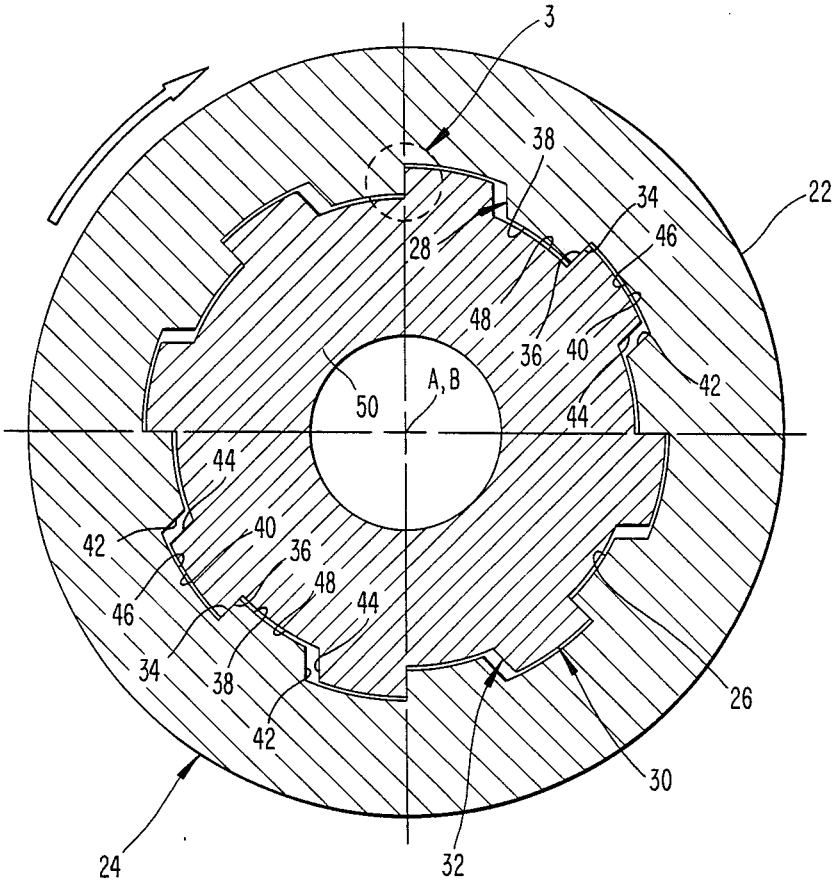
FIG. 2 is a cross-sectional view taken along lines 2–2 of FIG. 1.

A bit, generally indicated at 30 in FIGS. 1, 2 and 4, is coupled to the drill motor 24 adjacent the anterior end 12 of the drilling tool 10 for leading the drill motor 24 into the earth. The bit 30 has a centered position in the bore 26 of the drill motor 24 defined by an axis B thereof aligned with the central axis A of the drill motor 24. The bit 24 presents a series of axially extending circumferentially spaced external splines, generally indicated at 32, which mate with an engage the internal splines 28 when in the centered position.

The internal 28 and external 32 splines are disposed for axial relative, i.e., telescopic, movement and torsional transmission therebetween. As best shown in FIG. 2, each of the internal 28 and external 32 splines has a load bearing face 34, 36, respectively, expending in a plane radially outwardly from the central axes A, B. Each of the internal 28 and external 32 splines also includes a crest land 38, 40, respectively, extending circumferentially away from their respective load bearing faces 34, 36. The internal 28 and external 32 splines further include a non-load bearing face 42, 44, respectively, extending away from their respective crests 38, 40. Finally, each of the internal 28 and external 32 splines includes a root land 46, 48, respectively, extending between the non-load bearing faces 42, 44 and the load bearing faces 34, 36 of adjacent splines 28, 32, respectively.

The bit 30 includes an elongated cylindrical shank 50 disposed for telescopic movement in the bore 26 of the drill motor 24. The shank 50 has an upper end 52 supported in the bore 26 and a lower end 54 supported just outside of the bore 26, as shown in FIG. 1. An earth penetrating head 56 of the bit 30 extends axially from the lower end 54 of the shank 50 for cutting into rock and other solid material in the earth. The external splines 32 are supported circumferentially about the shank 40 and are disposed adjacent the lower end 54. In other words, the external splines 32 extend outwardly from the shank 50 adjacent the head 56 for mating engagement with the internal splines 28 in the bore 26.

As shown in FIG. 2, when the internal 28 and external 32 splines are disposed for operation in the centered position, wherein the respective axes A and B are aligned, a uniform radially measured outer clearance is provided between the external spline crests 40 and the internal spline roots 46. The outer clearance, therefore, comprises the spacing, measured in a radial direction, between the roots 46 of the internal splines 28 and the crests 40 of the external splines 32. This outer clearance is equivalent for each spline 28, 32 when the shank 50 is centered in the bore 26. Similarly, a uniform radially measured inner clearance is provided at the centered position between the external spline roots 48 and the internal spline crests 38. In other words, like the outer clearance, the inner clearance comprises the spacing, measured in a radial direction, between the crests 38 of the internal splines 28 and the roots 48 of the external splines 32.

The subject drilling tool 10 is characterized by the outer clearance being less than the inner clearance to prevent abrasive damage to the external spline roots 48 during axial relative movement between the drill motor 24 and the bit 30 so that the external spline crests 40 engage the internal spline roots 46 when the axis B of the bit 30 shifts laterally from the central axis A and away from the centered position while maintaining a clearance between the external roots 48 and the internal spline crests 38. Said another way, the clearance relationship of the subject invention, wherein the outer clearance is less than the inner clearance, is provided so that upon lateral movement of the bit 30 relative to the drill motor 24 only the crests 40 of the external splines 32 will come into contact with the internal splines 28. In this manner, galling and other such abrasive damage is prevented beyond a root diameter of the shank 50 defined by the diameter of a circle coincidental with each of the roots 48 of the external splines 32.

Figure 3:
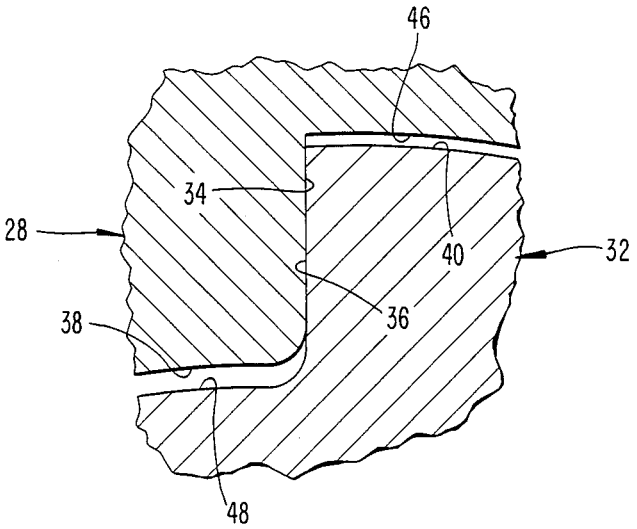
FIG. 3 is an enlarged view of the circumscribed area indicated at 3 in FIG. 2.

In furtherance of preventing point to point contact between any two sliding members, the external spline crests 40 and the internal spline roots 46 are formed with concentrically arced surfaces so that upon lateral shifting the entire external spline crest 40 surfaces contact the associated internal spline roots 46 and thus prevents galling and excessive abrasion. That is, because of the relatively small radial distance between the external spline crests 40 and the internal spline roots 46, the two surfaces are nearly parallel, as shown in FIG. 3.

Upon contact, therefore, the two lands 40, 46 contact practically upon their entire surfaces to prevent excessive abrasion.

As best shown in FIG. 2, each of the external spline non-load bearing faces 44 extends in a plane generally parallel to the associated external spline load bearing face 36. In other words, each non-load bearing face 44 of an external spline 32 is disposed in a plane parallel to a radial plane containing the plane of the load bearing face 36 of the associated external spline 32. Similarly, each internal spline non-load bearing face 42 extends in a plane generally parallel to the opposing external spline non-load bearing face 44. As shown in FIG. 2, each non-load bearing face 42 of the internal splines 28 is parallel to a radial plane containing the load bearing face 34 of an adjacent internal spline 28 spaced across the adjacent root 46.

Accordingly, when the internal 28 and external 32 splines are in the centered position, a circumferentially measured flushing clearance is provided between the internal spline non-load bearing faces 42 and the adjacent, or opposing, external spline non-load bearing faces 44. This flushing clearance is substantially greater than, or larger than, the inner clearance for allowing the passage of flushing fluids, i.e., air, during operation. Preferably, the combined volume of all of the flushing clearances is equivalent to the volume of the cylinder 18 stroked by the piston 20, i.e., the displacement volume of the cylinder 18. This allows effective venting and flushing of debris from about the head 56.

As shown in FIGS. 1 and 4, each of the external splines 32 includes an elongated relief cut 58 extending radially inwardly from the crest 40 and extending circumferentially from the load bearing face 36 to the non-load bearing face 44. That is, each of the relief cuts 58 extends the entire width of the associated external spline 32. The relief 58 are disposed only partially along the axial length thereof because lateral support is only required at the ends of the external splines 32. The relief cuts 58 function to reduce friction during relative axial movement between the internal 28 and external 32 splines without sacrificing lateral support.

A stop arrangement 60 shown in FIGS. 1 and 4 is provided for limiting the axial movement of the bit 30 relative to the drill motor 24 between two defined positions. Relative axial movement between the internal 28 and external 32 splines, in other words, is limited between two spaced stop positions. The stop arrangement 60 includes an annular rim 62 extending radially outwardly from the upper end 52 of the shank 50, and a coacting annular ring 64, shown in FIG. 1, which is fixedly disposed in the bore 26 of the drill motor 24. The ring 64 limits axial movement of the bit 30 to one of the defined positions by abutment against the rim 62 of the shank 50. This one defined position occurs when the bit 30 is telescoped out of the bore 26, as when the drilling tool 10 is being removed from a drilling hole. The stop arrangement 60 further includes an annular shoulder 66 extending radially outwardly from the lower end 54 of the shank 50. The shoulder 66 engages a lowermost end of the casing 22 to prevent further inward movement of the shank 50 into the bore 26, as shown in FIG. 1.

As shown in FIGS. 1 and 4, flow passages 68 are provided to direct fluid, i.e., compressed air, around the rim 62 of the bit 30 and around the ring 64 of the drill motor 24. The flow passages 68 comprise four axially extending channels 68 disposed in the shank 50 and extending radially inwardly through the rim 62. Thus, during operation, air moving through the flow passages 68 passes through the rim 62 and around the radially inward edge of the ring 64, and subsequently to the flushing clearance passages between the non-load bearing faces 42, 44 of the internal 28 and external 32 splines.

As previously mentioned, the subject invention overcomes the deficiencies in the prior art drilling tools by providing, in combination, full surface contacting load bearing faces 34, 36 of the mating internal 28 and external 32 splines, respectively, and a novel clearance relationship between the inner and outer clearances wherein the outer clearance is smaller than the inner clearance so that, during lateral shifts, a spacing is continually maintained between the external spline roots 48 and the internal spline crests 38. This unique combination improves the serviceable life of the spline connection operated under such severe conditions as rock drilling and also prevents premature failure of the shank 50 of the bit 30 due to galling below the root diameter.

Although the present invention has been described in connection with a preferred embodiment of the invention, it will be appreciated by those skilled in the art that modifications, substitutions, additions and deletions not specifically described may be made without departing from the spirit and scope of the invention, as defined in the appended claims.

What is claimed is:

1. A percussion drilling apparatus of the type for boring into the earth, said apparatus comprising:

drill motor means for producing a cyclic percussive force having a longitudinally extending central axis and a bore centered along said central axis presenting a series of axially extending circumferentially spaced internal splines; and bit means for leading said drill motor means into the earth having a centered position in said bore of said drill motor means defined by an axis thereof aligned with said central axis, said bit means presenting a series of axially extending circumferentially spaced external splines engaging said internal splines in said centered position;

said internal and external splines disposed for axial relative movement and torsional transmission therebetween and each having a load bearing face extending in a plane radially outwardly from said central axis, a crest land extending circumferentially away from said load bearing face, a non-load bearing face extending away from said crest, and a root land extending between said non-load bearing face and said load bearing face of adjacent splines;

said splines in said centered position including a uniform radially measured outer clearance between said external spline crests and said internal spline roots and a uniform radially measured inner clearance between said external spline roots and said internal spline crests;

said outer clearance being less than said inner clearance to resist abrasive damage to said external spline roots during axial relative movement between said drill motor means and said bit means so that said external spline crests engage said internal spline roots when said axis of said bit means shifts laterally of said central axis and away from said centered position while maintaining a spacing between said external spline roots and said internal spline crests.

2. An apparatus according to claim 1, wherein said centered position includes a circumferentially measured flushing clearance between said internal spline non-load bearing faces and the adjacent ones of said external spline non-load bearing faces, said flushing clearance being greater than said inner clearance to allow passage of flushing fluids during operation.

3. An apparatus according to claim 2, wherein each of said external splines includes an elongated relief cut extending radially inwardly from said crest and circumferentially from said load bearing face to said non-load bearing face.

4. An apparatus according to claim 3, wherein each of said external spline non-load bearing faces lies in a plane oriented generally parallel to the associated said external spline load bearing face.

5. An apparatus according to claim 4, wherein each of said internal spline non-load bearing faces lies in a plane oriented generally parallel to the opposing said external spline non-load bearing face.

6. An apparatus according to claim 5 including stop means for limiting axial movement of said bit means relative to said drill motor means between two defined positions.

7. An apparatus according to claim 6, wherein said bit means includes a cylindrical shank disposed for telescopic movement in said bore of said drill motor means and supporting said external splines, said stop means including an annular rim extending radially outwardly from said shank.

8. An apparatus according to claim 7, wherein said stop means includes an annular ring fixedly disposed in said bore of said drill motor means limiting axial movement of said bit means to one of said defined positions by engagement against said rim of said shank.

9. An apparatus according to claim 8, wherein said shank includes an upper end supported in said bore and a lower end supported outside said bore, said external splines disposed adjacent said lower end and said rim disposed adjacent said upper end.

10. An apparatus according to claim 9, wherein said stop means includes an annular shoulder extending radially from said lower end of said shank.

11. An apparatus according to claim 10, wherein said bit means includes an earth penetrating head extending axially from said lower end of said shank.

12. An apparatus according to claim 11 including at least one flow passage directing fluid around said rim of said bit means and said ring of said drill motor means.

13. An apparatus according to claim 12, wherein said flow passage includes an axially extending channel disposed in said shank and extending radially inwardly through said rim.

14. An apparatus according to claim 13, wherein said drill motor means includes an axially reciprocal piston responsive to pressurized fluid.

* * * * *